US005271713A

United States Patent [19]

Sheldon, Jr.

[11] Patent Number: 5,271,713

[45] Date of Patent: Dec. 21, 1993

[54] ADJUSTABLE INLET FOR A HARVESTER FAN

[75] Inventor: Donald H. Sheldon, Jr., Johnston, Iowa

[73] Assignee: Deere & Company, Moline, Ill.

[21] Appl. No.: 956,147

[22] Filed: Oct. 5, 1992

[51] Int. Cl.[5] ..... F04D 29/08

[52] U.S. Cl. ..... 415/128; 415/172.1; 415/173.2; 411/107; 411/384

[58] Field of Search ..... 415/126, 128, 170.1, 415/172.1, 173.2, 174.1; 411/107, 222, 383, 384, 535, 536

[56] References Cited

U.S. PATENT DOCUMENTS

| | | | |
|---|---|---|---|
| 1,326,673 | 12/1919 | Lepley | 415/126 |
| 1,743,916 | 1/1930 | Hargis | 415/128 |
| 3,316,025 | 4/1967 | Sullivan et al. . | |
| 4,925,364 | 5/1990 | Das | 411/383 |

FOREIGN PATENT DOCUMENTS

| | | | |
|---|---|---|---|
| 53298 | 9/1890 | Fed. Rep. of Germany | 415/172.1 |
| 78038 | 11/1894 | Fed. Rep. of Germany | 415/172.1 |
| 954835 | 12/1956 | Fed. Rep. of Germany | 415/173.2 |
| 2290133 | 5/1976 | France | 415/126 |
| 391287 | 1/1974 | U.S.S.R. | 415/128 |
| 2203491 | 10/1988 | United Kingdom | 415/128 |

*Primary Examiner*—Edward K. Look
*Assistant Examiner*—James A. Larson

[57] ABSTRACT

A harvester fan includes a donut-shaped insert which is rotationally molded with button-head bolts spaced therearound. The rotor-end of the bolts are molded into the sidewall of the insert so the sealing area of the insert remains planar for maximizing sealing ability. The opposite threaded ends of the bolts project from the insert, and rotation of a special nut held axially by snap ring and easily accessible by a wrench from outside the fan housing finely tunes the fan insert axially relative to the rotor for maximum output and efficiency.

9 Claims, 3 Drawing Sheets

ADJUSTABLE INLET FOR A HARVESTER FAN

BACKGROUND OF THE INVENTION

1. Field of the Invention

The present invention relates generally to harvesting equipment and, more specifically, to a fan for the air system of a harvester such as a cotton picker or stripper.

2. Related Art

Machines such as cotton pickers and strippers typically have a fan for moving harvested crop from the row units to the basket. The fan includes a housing carried by a frame-mounted support. A rotor supported within the housing draws air into a central inlet and expels air through a tangential outlet to a series of ducts leading to the row unit areas. Some fans include pair of donut-shaped inserts located on opposite sides of the rotor to act as seals between the low and high pressure areas. The efficiency and output of the fan is heavily dependent upon the placement of the inserts relative to the sides of the rotor. If the inserts touch the rotor, drag decreases the fan efficiency. However, if too large of a gap exists between rotor and insert, the fan output pressure will drop significantly as high pressure air leaks back to the low pressure inlet. The gap between the rotor and inserts is adjusted (as discussed below with reference to FIG. 1) using washers or shims at a series of mounting bolts which are spaced equidistantly around each insert. Indented areas on the rotor side of the insert adapted to receive the mounting bolts decrease the ability of the insert to seal between high and low pressure areas. Shimming requires removal of the fan from the harvester, as well as installation and/or removal of washers at each bolt location. As a result, proper adjustment of the fan is time-consuming and inconvenient. The shims or washers provide relatively imprecise adjustment so that fan output and efficiency cannot be fully optimized. In some instances, an improperly adjusted fan gap has been found to adversely affect fan performance so much that minimum fan specifications cannot be met.

BRIEF SUMMARY OF THE INVENTION

It is therefore an object of the present invention to provide an improved harvester fan. It is another object to provide such a fan which overcomes the aforementioned problems.

It is another object of the invention to provide an improved harvester fan having less parts, requiring less assembly, and being more easily adjusted for maximum output and efficiency than most previously available harvester fans.

It is still another object of the invention to provide an improved harvester fan having an easily adjustable sealing member adjacent the rotor. It is a further object to provide such a fan wherein the sealing member can be accurately adjusted without shims and without need to remove the fan from the harvester.

It is yet another object of the present invention to provide an improved harvest fan having an easily adjustable sealing member which is substantially planar adjacent the fan rotor for effectively sealing between high and low pressure areas.

A harvester fan includes a donut-shaped insert which is rotationally molded with button-head bolts spaced therearound. The rotor-end of the bolts are molded into the sidewall of the insert so the sealing area of the insert remains planar for maximizing sealing ability. The opposite threaded ends of the bolts project from the insert, and a special nut with a snap ring groove finely tunes the fan inlet axially relative to the rotor for maximum output and efficiency. The fan is adjustable while mounted on the harvester, and shims are obviated. Assembly time and the number of parts is reduced, ability to precisely tune the fan is increased, and fan performance is significantly enhanced by the structure.

These and other objects, features and advantages of the present invention will become apparent to one skilled in the art upon reading the following detailed description in view of the drawings.

DETAILED DESCRIPTION OF THE DRAWINGS

Figure 1:
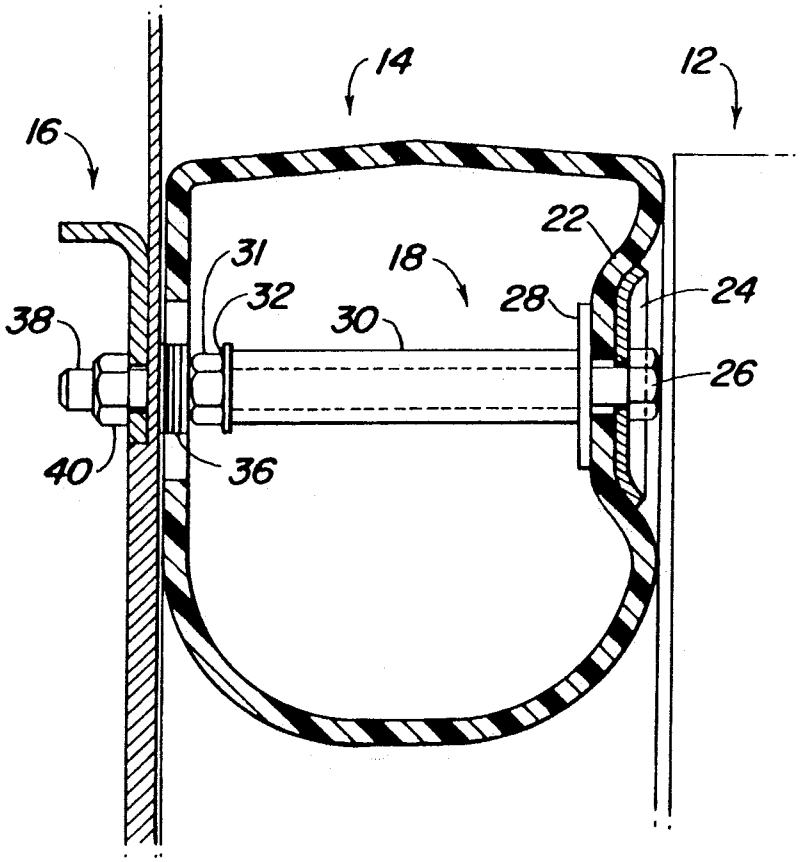
FIG. 1 (PRIOR ART)
FIG. 1 is a sectional view of a portion of the rotor and insert area of a conventional harvester fan.

1. Description of the prior art:

Referring to FIG. 1 of the drawings, therein is shown a portion of a conventional harvester fan 10 with an impeller or rotor 12 and inserts 14 (only one of which is shown) on opposite sides of the rotor 12 to seal between the high and low pressures areas. The insert 14 is hollow and donut-shaped and is mounted on a housing support 16 by bolt assemblies 18 inserted through apertures in the opposite sidewalls at locations spaced equidistant around the insert. The sidewall adjacent the rotor is indented at 22 to receive a special cupped washer 24 and bolt head end 26 of the assembly 18 out of interfering relationship with the rotor 14. The area 22 adversely affects the seal between high and low pressure areas by furnishing a path for high pressure air to short circuit to the low pressure area. A spacer 30, nut 31 and washer 32 sandwich the area 22 between the washer 24 and a second large washer 28. Shims or washers 36 are placed over the threaded end 38 between the nut 31 and the support 16, and the bolt assembly is secured to the support with a nut 40.

To adjust the insert 14 relative to the rotor 12, the fan 10 must be removed from the harvester and disassembled to add or remove washers 36. Adding washers 36 moves the insert 14 closer to the rotor 12, while removing washers 36 increases the distance between the insert 14 and rotor 12.

Figure 4:
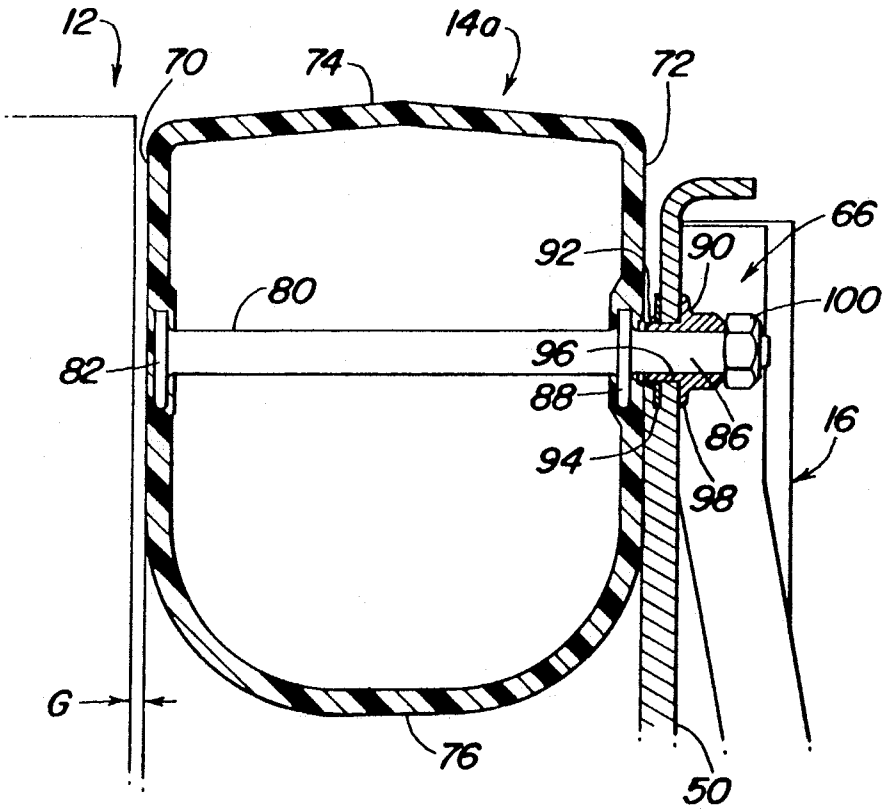
FIG. 4 is a view similar to FIG. 1 but showing an improvement in accordance with the teachings of the present invention.
Figure 2:
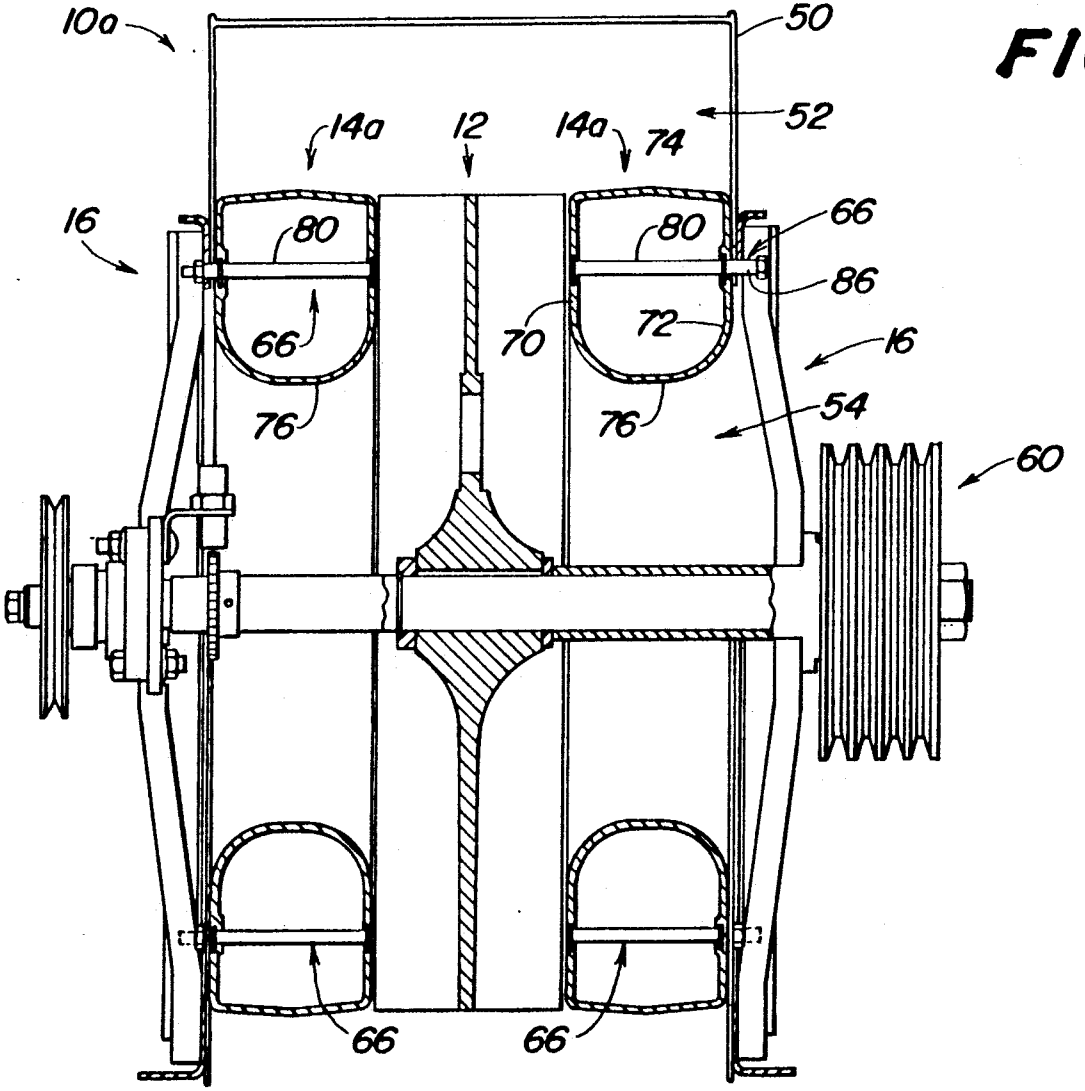
FIG. 2 is a sectional view of an implement fan constructed in accordance with the teachings of the present invention.
Figure 3:
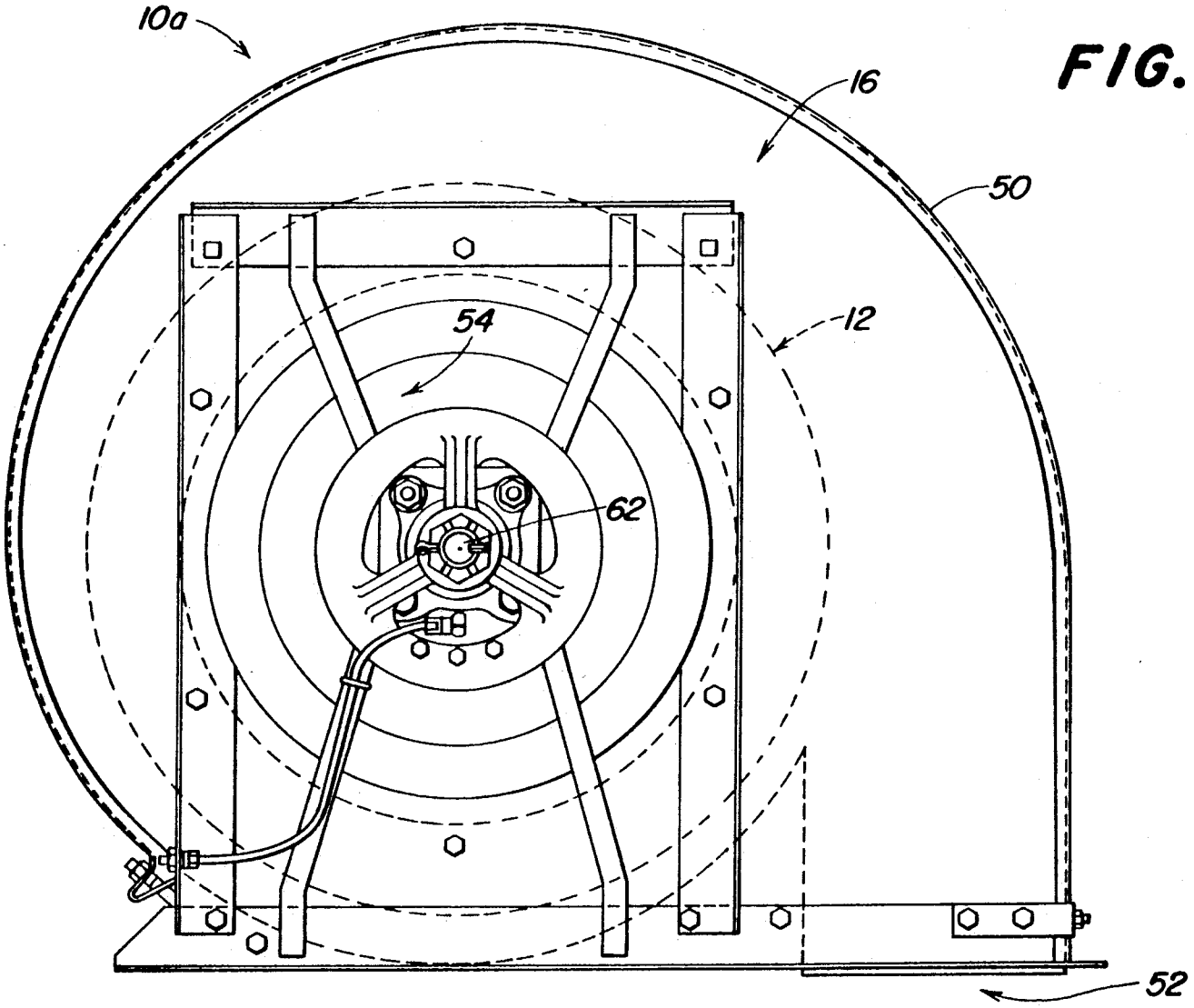
FIG. 3 is a side view of the fan of FIG. 2.

2. Description of the improved fan:

Referring now to FIGS. 2–4, therein is shown a fan **10*a* having a rotor 12 mounted in a housing 50 having an outlet 52 and an inlet 54. The housing 50 is carried on the support 16 which, in turn, is connected to the harvester frame (not shown). A pair of annular or donut-shaped hollow inserts 14*a* are adjustably mounted on opposite sides of the rotor 12 to seal the high pressure area from the low pressure area. A conventional belt-driven shaft and pulley arrangement 60 rotates the rotor 12** about a central shaft axis.

Each insert **14*a* is supported from the housing 50 and support 16 by six special bolt assemblies 66 spaced equidistantly around the insert. The insert 14*a* includes an inner planar sidewall 70 (FIG. 4) and an outer planar sidewall 72 joined by a radially outward and inward connecting walls 74 and 76, respectively. The insert 14***a* is fabricated from plastic material using a rotational molding technique. The insert is molded with the bolt assemblies 66 in position. Each bolt assembly 66 includes a special button head bolt 80 having a non-circular head end 82 which is molded into the inner sidewall 70 such that the surface of the sidewall 70 adjacent the rotor 12 remains planar (FIG. 4). The bolt includes an upset and threaded end 86 having an enlarged non-circular portion 88 around which is formed the outer sidewall 72 of the insert 14*a*. The non-circular enlarged portions 82 and 88 support the bolt 80 against rotation in the insert 14*a* with the threaded end 86 projecting a substantial distance outwardly from the sidewall 72 to facilitate single wrench assembly and adjustments as discussed in detail below. The bolt 80 also helps maintain insert shape.

A special nut 90, which is easily accessible outside the housing 50, supports the bolt 80 in the corresponding aperture in the support 16 or housing 50. The nut 90 is maintained in the aperture by a snap ring 92 and washer 94 which fit over a reduced-diameter portion 96 of the nut which projects inwardly in the direction of the rotor through the aperture. An enlarged portion 98 abuts the housing or support on the opposite side of the aperture and includes flats for receiving a wrench. During assembly, the end 86 of each bolt 80 is inserted through the corresponding aperture in the housing or support and the nut 90 is threaded onto the end 86 so that the reduced diameter portion 96 projects inwardly through the aperture. The snap ring 92 is then inserted in a groove in the reduced diameter portion 96 to maintain the nut against axial movement while permitting the nut to be rotated by a wrench placed over the flats. Each nut 90 is rotated to move the bolt 80 and thus the corresponding portion of the insert 14*a* to the precise location adjacent the rotor 12 to provide the desired gap (see G of FIG. 4) for optimum fan performance. Once the insert 14*a* is adjusted properly, lock nuts 100 are tightened against the special nuts 90 to maintain insert position. The threaded nut arrangement provides infinite adjustment capability with just a single wrench. The structure affords convenient access to the nuts outside the fan housing without removal of the fan from the harvester and without disassembly of the fan.

Having described the preferred embodiment, it will become apparent that various modifications can be made without departing from the scope of the invention as defined in the accompanying claims.

I claim:

1. In a harvester fan having a support, a housing connected to the support, a rotor mounted in the housing for rotation about an axis, the housing including a sidewall supported axially adjacent the side of the rotor, the sidewall including a generally annular insert having an inner wall adjacent the rotor, an outer wall opposite the inner wall, the improvement comprising means for adjusting the inner wall axially relative to the rotor comprising:

a bolt assembly including a bolt having a shank non-rotatably connected to the inner wall and the outer wall and maintaining a generally constant distance between the inner and outer walls, the inner and outer walls maintaining the shank in substantially a fixed perpendicular relationship to the inner wall, a threaded outer end projecting outwardly from the outer wall, and a nut member threaded unto the outer end; and means rotatably supporting the nut member from the support for moving the inner wall axially relative to the rotor upon rotation of the nut member.

2. The invention as set forth in claim 1 wherein the inner wall defines a generally planar surface facing the rotor, and the inner end of the bolt assembly is fixed to the inner wall inwardly of the planar surface.

3. The invention as set forth in claim 1 wherein the means rotatably supporting the nut member includes means for preventing substantial axial movement of the nut member relative to the support while facilitating rotation of the nut member relative to the threaded end to move the bolt axially relative to the support as the nut member is rotated.

4. In a harvester fan having a support, a housing connected to the support, a rotor mounted in the housing for rotation about an axis, the housing including a sidewall supported axially adjacent the side of the rotor, the sidewall including a generally annular insert having an inner wall adjacent the rotor, an outer wall opposite the inner wall, the improvement comprising means for adjusting the inner wall axially relative to the rotor comprising:

a bolt assembly including a bolt having a shank with an inner end connected to the inner wall, a central portion extending axially outwardly from the inner wall, a threaded outer end projecting through the outer wall, and a nut member threaded unto the outer end; and means supporting the nut member from the support for moving the inner wall axially relative to the rotor upon relative rotation of the nut member and bolt, wherein the bolt comprises an enlarged end molded into the inner wall.

5. The invention as set forth in claim 4 wherein the bolt includes an enlarged portion molded into the outer sidewall adjacent the threaded end for maintaining an generally constant distance between the inner and outer walls.

6. In a harvester fan having a housing, a rotor mounted in the housing for rotation about an axis, the housing conforming generally to the shape of the rotor and including a donut-shaped, generally hollow rotationally molded insert having an inner wall adjacent the rotor, the improvement comprising means for adjusting the inner wall axially relative to the rotor comprising:

the inner wall having a surface facing the rotor which is generally planar;

a bolt molded into the insert inwardly of the planar surface so that the planar surface is substantially uninterrupted, the bolt fixed against axial and rotational movement relative to the insert and including a central portion extending axially outwardly to a threaded outer end projecting towards the housing, and a nut member threaded unto the outer end, the nut member rotatably connected to the housing for moving the inner wall axially relative to the rotor upon rotation of the nut member, whereby the axial adjustment of the inner wall can be facilitated by rotating the nut member without need to manually hold the bolt against rotation.

7. In a harvester fan having a housing, a rotor mounted in the housing for rotation about an axis, a generally annular hollow plastic insert having an inner wall supported adjacent the rotor, an outer wall opposite the inner wall, a plurality of bolt assemblies spaced around the insert, each bolt assembly including a bolt, the bolt having a shank with an inner end fixed against rotation and axial movement to the inner wall, a central portion extending axially outwardly from the inner wall, a threaded outer end projecting through the outer wall and supported from the outer wall so the bolt is fixed against movement in a direction perpendicular to the shank, and a nut member threaded unto the outer end, the nut member rotatably supported from the housing and held against axial movement thereon for moving the inner wall axially relative to the rotor upon rotation of the nut member on the threaded end.

8. The invention as set forth in claim 7 wherein the inner wall has a rotor-side surface which is planar, and the inner end is molded into the inner wall outwardly of the planar surface so that the bolt does not project through the inner wall.

9. The invention as set forth in claim 7 wherein the bolt includes an enlarged portion adjacent the outer end, the enlarged portion molded into the outer wall and maintaining a fixed distance between the inner and outer walls.

* * * * *